United States Patent [19]

Nickell

[11] 4,211,024

[45] Jul. 8, 1980

[54] MAGIC DRINKING STRAW

[76] Inventor: Joe H. Nickell, 377 Prestonsburg St., West Liberty, Ky. 41472

[21] Appl. No.: 889,094

[22] Filed: Mar. 22, 1978

[51] Int. Cl.[2] ..... G09F 19/00; A47G 21/18

[52] U.S. Cl. ..... 40/406; 40/439; 239/33; D7/42

[58] Field of Search ..... 40/406, 407, 427, 439, 40/326; 46/1, 41, 42; 239/33; D7/42

[56] References Cited

U.S. PATENT DOCUMENTS

| | | | |
|---|---|---|---|
| D. 225,486 | 12/1972 | Bart | D7/42 |
| D. 240,789 | 8/1976 | Frumkin | 46/41 X |
| 2,619,770 | 12/1952 | Dinhofer | 239/33 X |
| 2,689,424 | 9/1954 | Clagett | 40/427 |
| 3,256,627 | 6/1966 | Adair | 40/427 |

*Primary Examiner*—John F. Pitrelli
*Assistant Examiner*—G. Lee Skillington

[57] ABSTRACT

A drinking straw with a hollow box connected to the straw such that a fluid can be drawn through the box and one face of the box can be seen by the user. The viewed face has transparent indicia surrounded by solid black or dark colored material corresponding to the material of the rear plate of the box, hence, the indicia is only visible when a colored fluid such as milk is drawn through the straw and the box.

3 Claims, 1 Drawing Figure

MAGIC DRINKING STRAW

SUMMARY OF THE INVENTION

My invention relates to drinking straws and more particularly to a magic drinking straw provided with a means whereby a self-contained or separately-attachable pictorial is rendered visible as milk is drawn upward through the straw.

An object of my present invention is to encourage children to drink milk.

A further object of my invention is to provide amusement in the form of a magic trick.

A still further object of the invention resides in an article of manufacture of the character set forth which is comparatively simple in its construction, inexpensive to manufacture, and which is efficient for the purposes for which it is intended.

Briefly, my present invention is a magic drinking straw comprised of two lengths of hollow tubing joined by a hollow enclosed member, which member has a pictorial superimposed thereon. Negative areas of the pictorial are rendered in black (or other) color upon transparent material, the positive areas of the pictorial remaining transparent. A rear wall of the enclosed connecting member is also of black (or other) color, and this is viewed through the transparent areas of the superimposed pictorial. The effect of black-on-black (or other color on similar color) thereby renders the pictorial in a camouflaged manner; however, when milk is drawn through the straw, and passes between the rear wall and the pictorial, the effect is of a pictorial rendered in black-and-white. Preferably, the connecting member which bears the pictorial is set at an angle suitable for being viewed when the magic drinking straw is being used.

BRIEF DESCRIPTION OF THE DRAWINGS

The objects and features of the invention may be understood with reference to the following detailed description of an illustrative embodiment of the invention, taken together with the accompanying drawing in which.

DESCRIPTION OF THE PREFERRED EMBODIMENT

Figure 1:
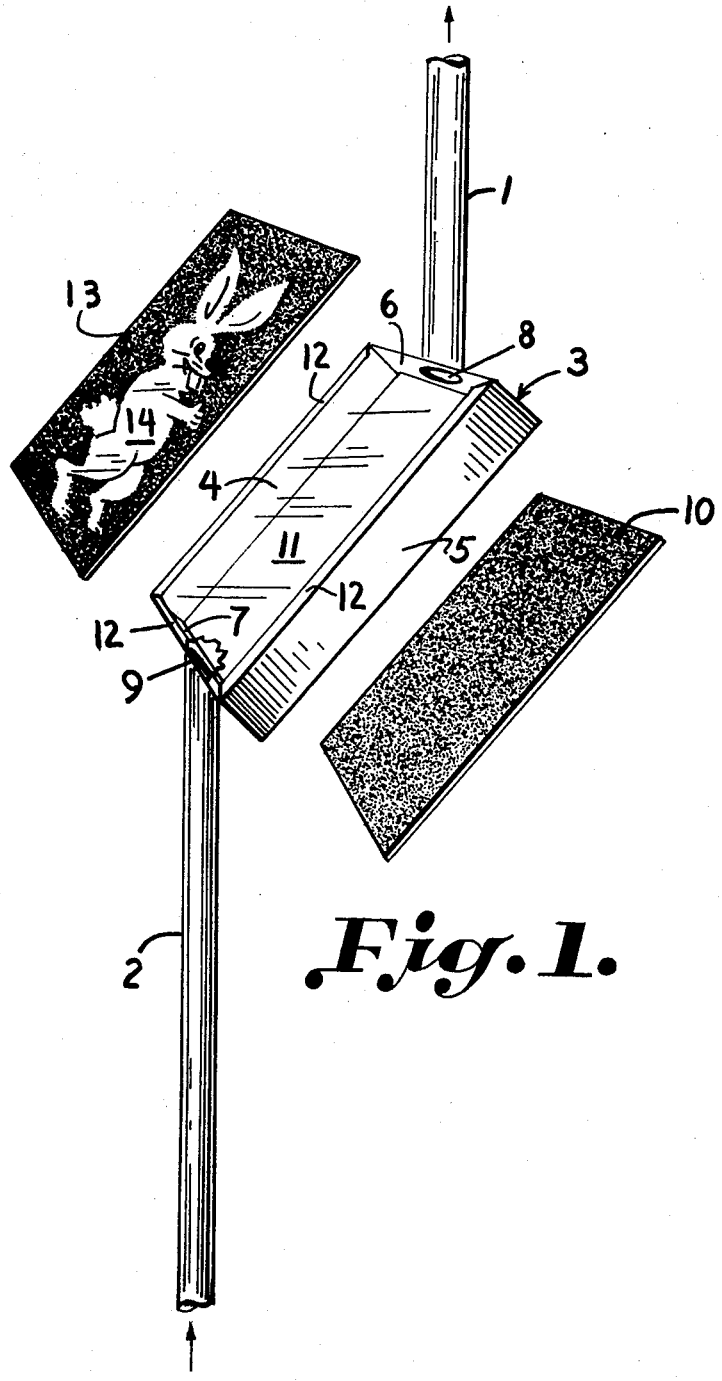
FIG. 1 illustrates an exploded perspective view of my invention.

Turning now descriptively to the drawing, in which similar reference characters denote similar elements throughout, FIG. 1 shows the magic drinking straw characterizing the present invention. It comprises two lengths of hollow tubing 1,2 angularly connected by an enclosed box-like member 3, said member 3 having two long sides 4,5 joined by ends 6,7. Said end 6 has an aperture 8 coinciding with the connecting end of said tube 1, and said end 7 has an aperture 9 (shown in a sectional portion) coinciding with the connecting end of said tube 2. Said member 3 has a rear wall 10 of black-color material and a front wall 11 of transparent material, said transparent front wall 11 being bordered on three edges by molding 12 and open near end 6. Said molding 12 forms a channel by which insertable piece 13 may be contained to cover said transparent front wall 11. Said insertable piece 13 is of transparent material colored black overall, excepting those portions of a pictorial 14 which remain transparent.

Hence, obvious changes may be made in the specific embodiment of the invention described herein, such modifications being within the spirit and scope of the invention claimed, it is intended that all matter contained herein is intended as illustrative and not as limiting in scope.

I claim:

1. A magic drinking straw comprising:

two open-ended hollow tubes, each having first and second ends;

a hollow enclosed connecting member having a rear wall of black or other dark-color material, and opposed thereto a front wall of transparent material, said connecting member having apertures in opposite ends, the top said aperture receiving the second end of the first said tube, and the bottom said aperture receiving the first end of the second said tube; and a pictorial pattern borne upon said transparent front wall of said connecting member, said pattern being rendered in black or other dark-color for its negative areas, and the positive areas of said pictorial pattern remaining transparent.

2. A magic drinking straw as recited in claim 1, having means whereby any one of a plurality of separate transparent pieces may be held in place covering said transparent front wall of said enclosed connecting member, said separate transparent pieces each bearing a pictorial pattern, each said pattern being rendered in black or other dark color for its negative areas, and the positive areas of said pattern remaining transparent.

3. A magic drinking straw as claimed in claim 1 or claim 2, said enclosed connecting member being joined to said two tubes at an angle suitable for being viewed by the person using said magic drinking straw.

* * * * *